US007625616B2

(12) United States Patent
Van de Camp

(10) Patent No.: US 7,625,616 B2
(45) Date of Patent: Dec. 1, 2009

(54) SUPPORT POST WITH IMPROVED AXIAL STRENGTH

(75) Inventor: Johannes Wilhelmus Van de Camp, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 574 days.

(21) Appl. No.: 11/160,434

(22) Filed: Jun. 23, 2005

(65) Prior Publication Data

US 2006/0292368 A1 Dec. 28, 2006

(51) Int. Cl.
*B32B 29/00* (2006.01)

(52) U.S. Cl. ..... 428/34.2; 206/586

(58) Field of Classification Search ..... 206/424, 206/455, 586, 320, 449, 479, 565, 594, 453, 206/521, 584; 229/146, 160.1; 261/94, DIG. 72; 383/49, 10, 33, 35, 36, 44, 61.2, 63, 65, 69; 403/402, 403; 427/378, 389, 393.4, 412, 427/416; 428/542.2, 34.2, 364; 138/153
See application file for complete search history.

(56) References Cited

U.S. PATENT DOCUMENTS 3,627,218 A * 12/1971 Feldschau ..... 242/530.2
4,131,701 A * 12/1978 VanAuken ..... 138/143
4,272,971 A * 6/1981 Loyd et al. ..... 464/181
4,482,054 A * 11/1984 Gardner ..... 206/594
4,483,444 A * 11/1984 Gardner ..... 206/594
4,771,893 A * 9/1988 Liebel ..... 206/586
5,593,039 A * 1/1997 Ortlieb ..... 206/586
5,688,578 A * 11/1997 Goodrich ..... 428/136
5,914,163 A * 6/1999 Browne ..... 428/36.1
6,164,444 A * 12/2000 Bray et al. ..... 206/268
6,186,329 B1 * 2/2001 Qiu ..... 206/586
6,286,683 B1 * 9/2001 Hunt et al. ..... 206/586
6,423,025 B1 * 7/2002 Buzot ..... 604/15
6,513,662 B1 * 2/2003 Stebelton ..... 206/586
7,128,214 B2 * 10/2006 Qiu et al. ..... 206/586
2002/0189969 A1 * 12/2002 Renck ..... 206/586
2005/0035257 A1 2/2005 Niu et al.

OTHER PUBLICATIONS

Literature Online Reference. (http://lionreference.chadwyck.com/initRefShelfSearch.do?initialise=true&listType=mwd). Post & Mandrel. (3 Pages).*
Excerpt from Feldman, When Do Fish Sleep?, 1989, download from http://www.ebookwise.com/ebooks/b36722/When-Do-Fish-Sleep/David-Feldman/?si=43 on Sep. 15, 2009.*

* cited by examiner

*Primary Examiner*—Callie E Shosho
*Assistant Examiner*—Elizabeth Robinson
(74) *Attorney, Agent, or Firm*—Clausen Miller PC

(57) ABSTRACT

An improved support post for cushioning and supporting large products is provided. The post is made from a non-rectangular sheet that is convolutely wound around a mandrel and shaped into a desired cross-sectional shape. The post has a higher axial compression strength than a conventional post.

7 Claims, 3 Drawing Sheets

SUPPORT POST WITH IMPROVED AXIAL STRENGTH

FIELD OF THE INVENTION

This patent relates to protective packaging for large appliances such as washers, dryers and refrigerators. More particularly, this patent relates to an improved tubular-type protective support post that has a higher axial compression strength than conventional support posts.

DESCRIPTION OF THE RELATED ART

Tubular type support posts are used for supporting axial compressive loads and protecting the corners and sides of goods such as washers, dryers, refrigerators, dishwashers and stoves. The support posts provide stacking strength as well as lateral protection. Conventional tubular support posts are made of a single sheet of rectangular paper wound into a convolute tube. Adhesive is often used to bond the paper layers. Before the adhesive dries, the tube is shaped into the desired shape, typically one with a modified "L" shaped cross section to fit snugly between the outer corner of an appliance and the inner corner of the appliance container.

Various support posts are described in the literature. For example, commonly owned Qiu U.S. Pat. No. 6,186,329 describes a support post made of multiple sheets of paper joined end to end and then wound around a mandrel so that the post wall has a strong-weak-strong profile in the transverse direction. In other words, a relatively weaker, less expensive grade of paper is sandwiched between layers of relatively stronger, costlier paper to form the post. Niu et al. U.S. Published Patent Application No. 2005-0035257A1, also commonly owned, discloses an improved support post made from a convolutely wound sheet comprising multiple thicknesses of paper. After winding the sheet into a tube, the paper that forms the middle layer(s) of the post is thicker than the paper that forms the outer layers. As a consequence, the post has a higher axial compression strength than a conventional post, but with the same amount (weight) of material.

The failure mode of a support post under axial compression is buckling, which at best results in an unattractive, partially crushed, outer package and at worst causes damage to the product inside the package. It is therefore an object of the present invention to provide a wound paperboard support post with increased axial compression strength.

Another object of the present invention is to provide a high strength support post made from a sheet of paperboard or other material that has been cut into a specific non-rectangular pattern or shape.

Still another object of the invention is to provide a high strength support post that is made of less material than a conventional support post.

Further and additional objects will appear from the description, accompanying drawings, and appended claims.

SUMMARY

The present invention is a support post with improved axial compression strength. The support post is made from a sheet of material, typically paperboard, cut into a specific non-rectangular shape that, when wound, results in a post having a greater wall thickness in the middle of the post than near the ends. The wall thickness is determined by the number of layers of material in the wound post.

In order to make a post according to the invention, a large sheet of material is cut into specific non-rectangular patterns as it comes off the roll to form multiple cut sheets of uniform dimensions. Each cut sheet is then wound onto a mandrel so that the middle area of the post (the area between the ends of the post) is thicker (has more layers of material) than the areas near the ends. The wound sheet may be shaped with special tools into a desired cross-sectional shape to form the finished support post.

The finished support posts have a higher axial strength and better buckling resistance than conventional support posts made from rectangular sheets having the same total surface area and made from identical paper. The wall thickness of the support post is no longer uniform in the axial direction, but increases continuously or step wise from either end toward the middle of the post.

THE DRAWINGS

DETAILED DESCRIPTION OF THE INVENTION

Figure 1:
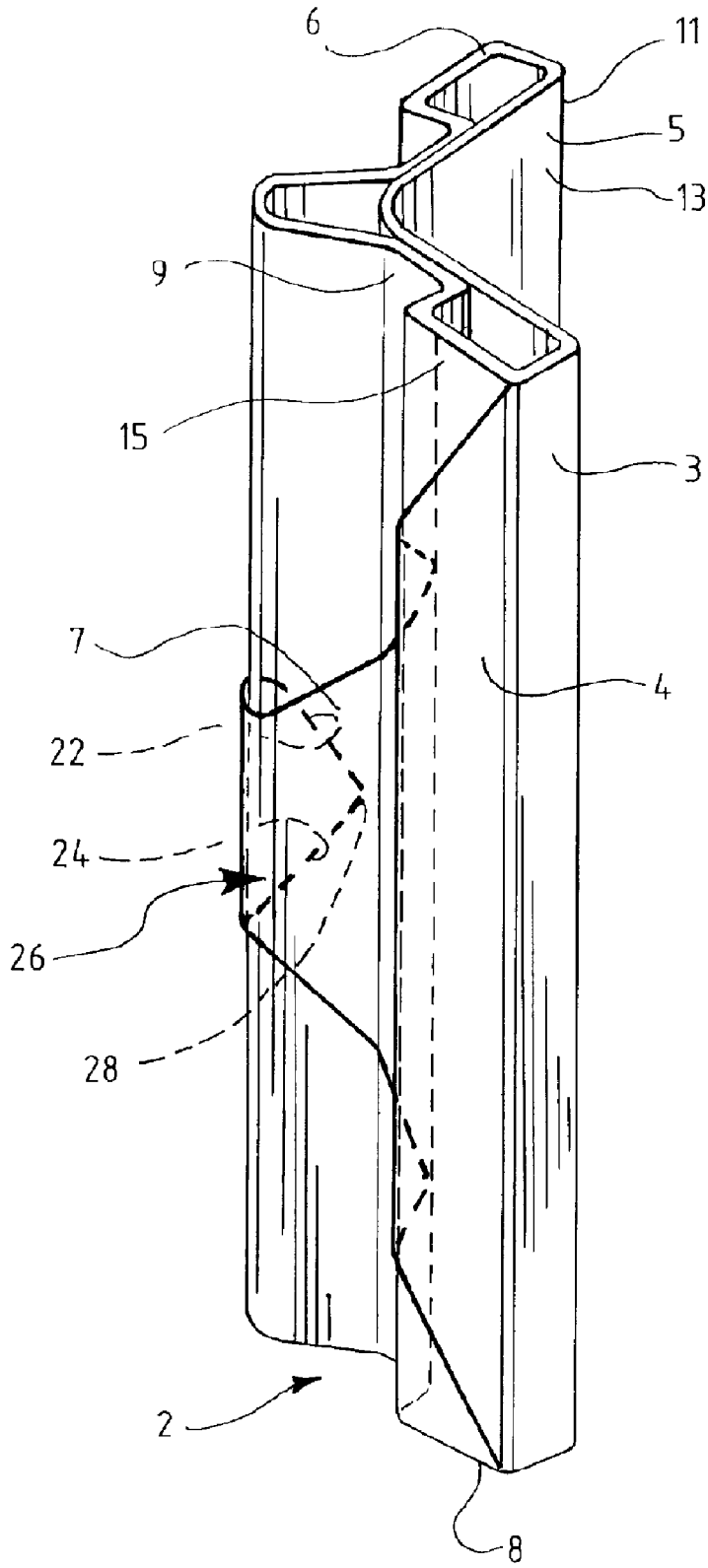
FIG. 1 is a perspective view of a support post made according to the present invention.

Turning to the drawings, there is shown in FIG. 1 a perspective view of a tubular-type support post 2 made according to the present invention. The support post 2 typically extends from a base pad (not shown) located at the bottom of a product package to a top cap or lid (not shown). The support post 2 protects and cushions the product from transverse (horizontal) forces during handling. In addition, the support post helps support the package against axial (vertical) compressive forces, such as when packages are stacked.

The support post 2 comprises two legs 4, 5 that form a right angle to fit the outer edge of an appliance. The support post 2 also comprises an inner, product facing wall 13 and an outer wall 15 that faces the package or container, the two walls in generally parallel spaced relation to each other to form a hollow interior. The support post 2 has a top end 6, a bottom end 8 and a middle area or section 7 interposed between the top and bottom ends 6, 8.

Inwardly extending beads or grooves 9 may be formed in the outer wall along each leg at a location spaced from the rounded ends 3, 11 of the legs 4, 5. As shown in FIG. 1, the beads 9 may extend the entire vertical length of the outer wall 15 and may contact the inner wall 13, thus forming multiple enclosed areas within the support post 2.

Support posts may be used in the following manner. After a large appliance is manufactured, it may be placed on and fastened to a pallet or base having dimensions greater than the width and depth of the appliance so the base can accommodate support posts. A protective sleeve typically made of paperboard or corrugated board is placed over the appliance to form the four sidewalls of the container. The sleeve fits inside the perimeter of the base. The support posts are placed around the appliance between the appliance and the protective sleeve. A paperboard or corrugated top is placed over the package. Straps or bands may be stretched around the container to better secure the support posts between the appliance and the container.

The support post typically is formed from a rectangular sheet of paper or paperboard convolutely wound into a tubular configuration and formed into a desired shape. Adhesive may be applied between the paper layers. Before the adhesive dries, the convolute tube is shaped into the desired cross-sectional shape. The support post should be shaped to fit snugly between the corner of an appliance and the corners of the appliance container.

Since the support posts are required to withstand significant vertical compression forces, especially when packaged appliances are stacked on top of one another, it is desirable to provide a support post having increased stacking strength. The present invention addresses this need by providing a support post with improved axial compression strength. The support post is made from a sheet of material, typically paperboard, cut into specific non-rectangular shapes that, when wound, result in a post having a greater wall thickness in the middle of the post between the ends. The wall thickness is determined by the number of layers of material in the wound posts.

Figure 2:
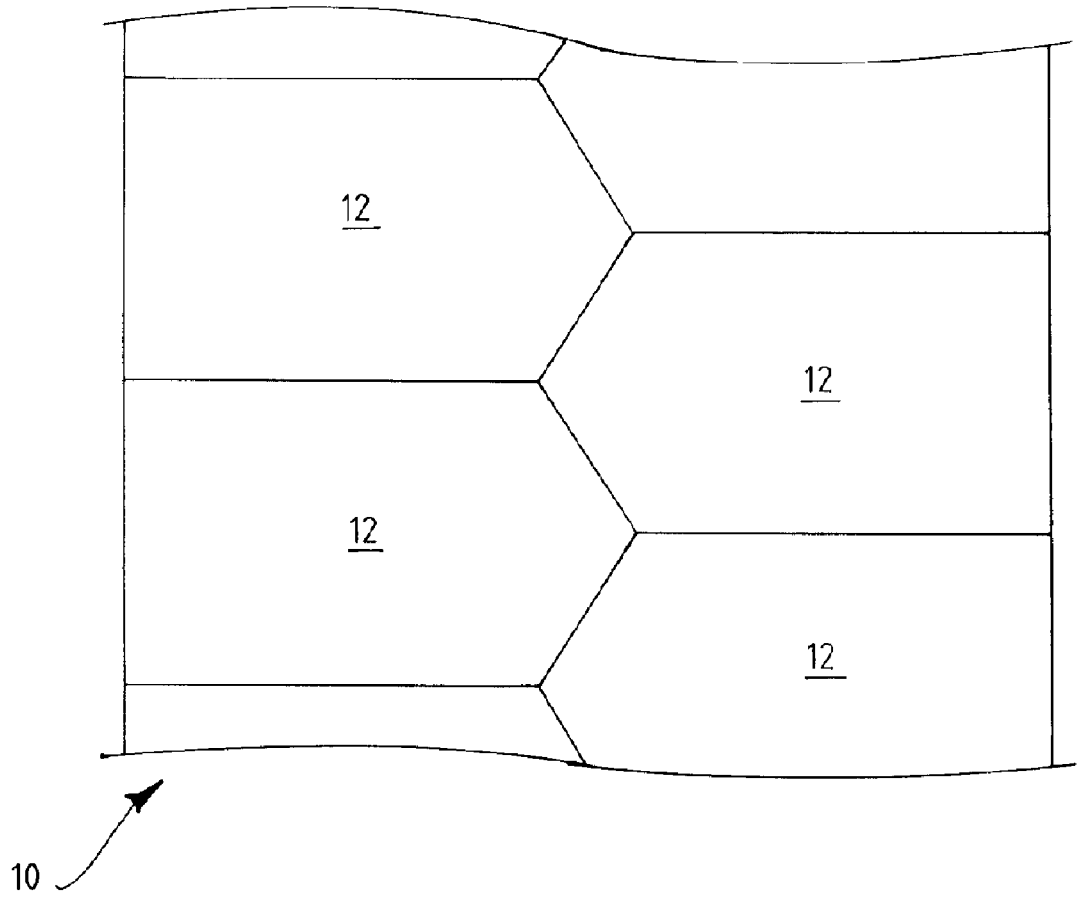
FIG. 2 is a top plan view of a sheet of material showing a cut pattern used to produce multiple sheets for forming support posts according to the present invention, not drawn to scale.

In order to make a post according to the invention, a large sheet of material 10 is cut into a specific non-rectangular pattern as it comes off the roll to form multiple cut sheets 12 of uniform dimensions, as shown in FIG. 2. Each cut sheet 12 is then wound onto a mandrel so that the middle section of the post 2 is thicker (has more layers of material) than the areas near the ends of the post. The wound sheet may be shaped with special tools into a desired cross-sectional shape.

Use of the specially cut sheets 12 results in support post having a higher axial compression strength and increased buckling resistance. The wall thickness of the post is no longer uniform in the axial direction as in a conventional post, but increases continuously or step wise from either end toward the middle of the post.

Figure 3:
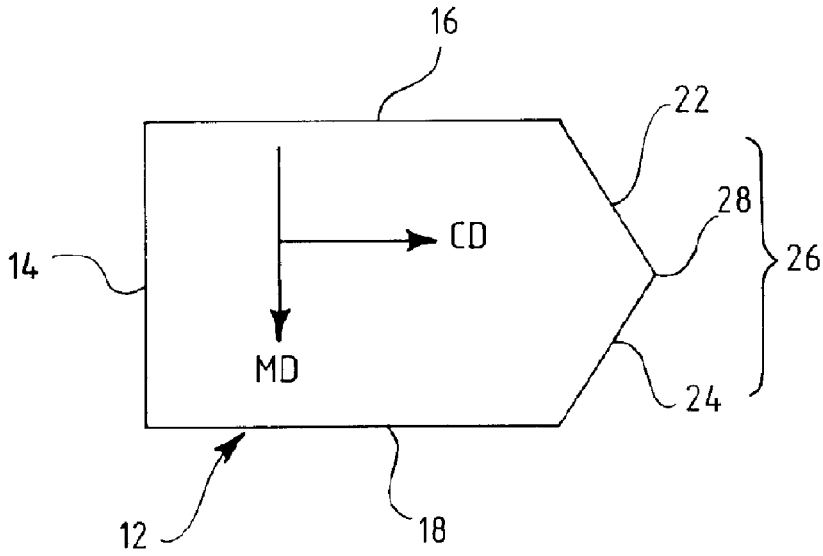
FIG. 3 is a top plan view of one of the cut sheets of FIG. 2.

FIG. 3 shows a cut sheet 12 ready to be wound and formed into a support post. The sheet 12 has a machine direction designated as MD in the figure and a cross direction perpendicular to the machine direction and designated as CD. The machine direction is the direction in which the greater number of sheet fibers tend to be oriented as a result of the forward motion of the papermaking machine wire, and thus the paper is stronger in this direction.

Still referring to FIG. 3, the cut sheet 12 has a pentagonal shape, and comprises a straight (uncut) side or edge 14, a top edge 16, a bottom edge 18, and two shorter angled edges 22, 24. Together the upper and lower angled edges 22, 24 comprise a V-shaped trailing edge 26 having an apex 28. When wound, the top and bottom edges 16, 18 of the sheet 12 become the top end 6 and bottom end 8 of the support post 2 shown in FIG. 1. The length of the straight edge 14 (the dimension of the cut sheet in the machine direction) will become the height of the support post 2.

To manufacture the support post 2 according to one embodiment the present invention, a large sheet of paper 10 is fed from a roll to a cutting station where the large sheet 10 is cut to produce sheets 12 having the non-rectangular shape shown in FIG. 3. Each cut sheet 12 is then fed to a mandrel straight (leading) edge 14 first for winding. Because of the irregular shaped trailing edge 26, the cross sectional thickness of the resulting support post 2 is no longer the same at any position. Rather, the support post cross section increases continuously when going from either end 6, 8 of the post 2 toward the middle section 7 and is greatest at the cross section that includes the leading edge apex 28. The thicker middle section 7 results in a support post 2 having increased axial strength and increased buckling resistance.

The top edge 16 of the sheet 12 forms the top end 6 of the post 2, and the bottom edge 18 of the sheet forms the bottom end of the post 2. The straight leading edge 14 of the sheet 12 forms a straight lap seam on the inner surface of the post 2 while the non-straight trailing edge 26 forms a seam (not shown in FIG. 1) on the outer surface of the post 2.

Figure 4:
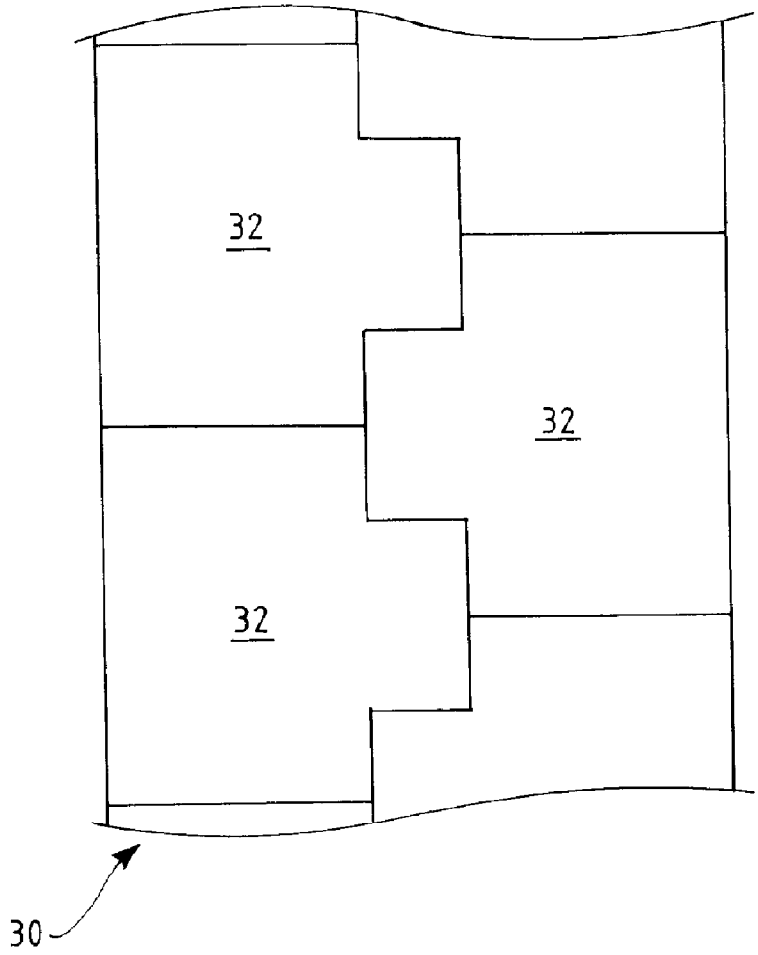
FIG. 4 is a top plan view of a sheet of material showing a cut pattern used to produce multiple sheets for forming support posts according to the present invention, not drawn to scale.

In a second embodiment of the invention, a large sheet 30 of material is cut into a different non-rectangular pattern to form multiple cut sheets 32 of uniform dimensions, as shown in FIG. 4. Each cut sheet 32 is then wound onto a mandrel so that the middle of the post will be thicker (have more layers of material) than the end portions. As before, the wound sheet may be shaped with special tools into a desired cross-sectional shape.

Figure 5:
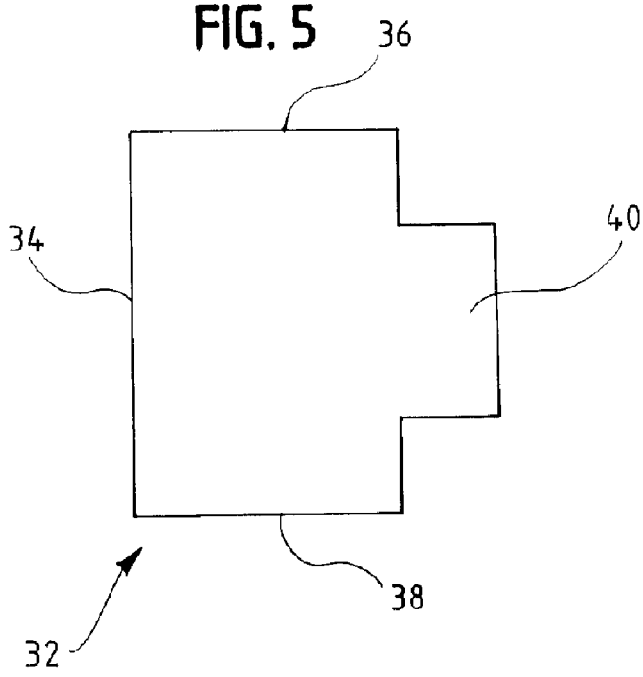
FIG. 5 is a top plan view of one of the cut sheets of FIG. 4.

Referring to FIG. 5, the cut sheet 32 has an octagonal shape, and comprises a straight (leading) edge 34, a top edge 36, a bottom edge 38, and a stepped (trailing) portion 40 having a height (dimension in the machine direction) shorter than the height of the rest of the sheet 32. The stepped portion 40 is located intermediate the top and bottom edges 36, 38 and preferably centered therebetween so that, when wound, the resulting support post has a middle portion thicker than the end portions. However, instead of having a continuously increasing cross sectional thickness as in the previous embodiment, the cross sectional thickness increases stepwise when going from either end of the post toward the middle. In other words, a support post made from the sheet 34 of FIG. 5 will have one cross-sectional thickness near either end and a second, larger cross sectional thickness at the middle section 7 that includes stepped portion 40. As before, the thicker middle portion results in a support post having increased axial strength and increased buckling resistance.

While the embodiments described above are all support posts having a substantially L-shaped cross-sectional profile, it is to be understood that the post may assume other shapes, such as a side post having an I-shaped cross-sectional profile or a post having a triangular, round or angular cross-sectional profile. The side post, like the L-shaped corner post, is made from a non-rectangular sheet of material wound into a tube and formed on a mandrel into a post having a desired cross-sectional shape.

In addition, the material used for the posts need not be paper (broad term) or paperboard (narrow term), but can be any material suitable for support post construction. And although the invention has been described in terms of tubular posts, the posts can also be formed such that the post has little or no hollow interior space.

Further modifications and alternative embodiments of the invention are contemplated which do not depart from the scope of the invention as defined by the foregoing teachings and appended claims. It is intended that the claims cover all such modifications that fall within their scope.

What is claimed is:

1. A corner post for protecting and cushioning a product, the corner post made from a single sheet of paper convolutely wound into an elongated hollow tube, the corner post comprising:

a top section having a thickness;

a top edge defined by multiple layers of paper;

a bottom section having a thickness;

a bottom edge defined by multiple layers of paper;

the top and bottom edges defining parallel planes; and a middle section interposed between the top and bottom sections, the middle section having a thickness greater than the thickness of the top and bottom wherein the single sheet of paper has a non-rectangular tessellating shape; and wherein the post has a substantially L-shaped cross-sectional profile.

2. The post of claim 1 wherein the cross-sectional thickness increases continuously along the length of the post beginning at the ends and moving toward the middle section.

3. The post of claim 1 wherein the cross-sectional thickness increases stepwise along the length of the post beginning at the ends and moving toward the middle section.

4. The post of claim 1 wherein the sheet has a straight top edge that forms the top end of the post, a straight bottom edge that forms the bottom end of the post, a straight leading side edge that forms a straight lap seam on the inner surface of the post, and a non-straight trailing edge that forms a seam on the outer surface of the post.

5. The post of claim 4 wherein the sheet is made from paper and the straight leading edge is parallel to the sheet machine direction.

6. The corner post of claim 1 wherein the sheet is pentagonal and comprises a straight side edge, a top edge, a bottom edge and a V-shaped trailing edge comprising two shorter angled edges.

7. The corner post of claim 1 wherein the sheet is octagonal and comprises a straight leading edge, a top edge, a bottom edge and a stepped trailing portion having a height shorter than the height of the rest of the sheet.

* * * * *